US006746222B2

(12) United States Patent
Skillman

(10) Patent No.: US 6,746,222 B2
(45) Date of Patent: Jun. 8, 2004

(54) BOTTOM DISCHARGE VALVE

(76) Inventor: Milton Skillman, Rte. 1 Box 216, Mount Vernon, TX (US) 75457

( * ) Notice: Subject to any disclaimer, the term of this patent is extended or adjusted under 35 U.S.C. 154(b) by 7 days.

(21) Appl. No.: 10/201,222

(22) Filed: Jul. 22, 2002

(65) Prior Publication Data

US 2004/0013551 A1 Jan. 22, 2004

(51) Int. Cl.[7] ..... F04B 39/10; F04B 53/00

(52) U.S. Cl. ..... 417/555.2; 417/554; 417/430; 166/332.3; 137/528

(58) Field of Search ..... 417/555.2, 555.1, 417/460, 554, 430, 553, 569, 570, 454; 137/528, 533.11; 166/316, 332.3, 332.6, 332.7

(56) References Cited

U.S. PATENT DOCUMENTS 3,479,958 A * 11/1969 Anderson et al. ..... 103/46
5,061,159 A * 10/1991 Pryor ..... 417/54
5,407,333 A * 4/1995 Lambright ..... 417/514
6,273,690 B1 * 8/2001 Fischer, Jr. et al. ..... 417/555.2
6,368,084 B1 4/2002 Skillman ..... 53/12
6,481,987 B2 * 11/2002 Ford ..... 417/554

* cited by examiner

*Primary Examiner*—Justine R. Yu
*Assistant Examiner*—Han L Liu
(74) *Attorney, Agent, or Firm*—Russell J. Egan

(57) ABSTRACT

A bottom discharge valve is located on the bottom of the pump barrel just above the standing valve. The externally threaded pin end of the standing valve threads into the lower internally threaded portion of the bottom discharge valve. The externally threaded or pin end of the bottom discharge valve is large enough to allow the plunger cage or the traveling valves to actually stroke into the hollow portion of the neck or pin end of the disclosed bottom discharge valve.

4 Claims, 2 Drawing Sheets

BOTTOM DISCHARGE VALVE

BACKGROUND OF THE INVENTION

1. The Field of the Invention

The present invention pertains to beam pumping wells and, more particularly, to a bottom discharge valve for use in beam pumping wells having a reciprocating downhole pump.

2. The Prior Art

Bottom discharge valves are typically used with a reciprocating downhole pump portion of a beam pumping well. The bottom discharge valve is mounted just above the standing valve. Prior art bottom discharge valves have included three main parts. The first part is a bottom discharge valve body which oftentimes is very restrictive to the free flow of fluid from the well. The second part is a plunger cage. The third part is a long sleeve which surrounds the plunger cage. Typically the long sleeve is threaded onto the bottom discharge valve body. When the parts are assembled together, their length generally exceeds 12 inches.

The reason a bottom discharge valve is used is to push some of the fluid between the tubing and the pump barrel from the pump barrel in order to keep any sand contained in the fluid from settling out between the pump barrel and the tubing. Sand settling between the pump barrel and the tubing may actually cause the pump to stick in the tubing.

For a description of the operation of reciprocating pumps of the type used for producing fluids from subsurface wells, reference is made to my U.S. Pat. No. 6,368,084, the disclosure of which is incorporated herein by reference.

SUMMARY OF THE INVENTION

The bottom discharge valve of the present invention is located on the bottom of the pump barrel just above the standing valve. The externally threaded pin end of the standing valve threads into the lower internally threaded portion of the bottom discharge valve of the present invention. The externally threaded or pin end of the disclosed bottom discharge valve is large enough to allow the plunger cage or the traveling valves to actually stroke into the hollow portion of the neck or pin end of the disclosed bottom discharge valve.

BRIEF DESCRIPTION OF THE DRAWINGS

The present invention will now be described, by way of example, with reference to the drawings, in which.

DETAILED DESCRIPTION OF THE INVENTION

Figure 1:
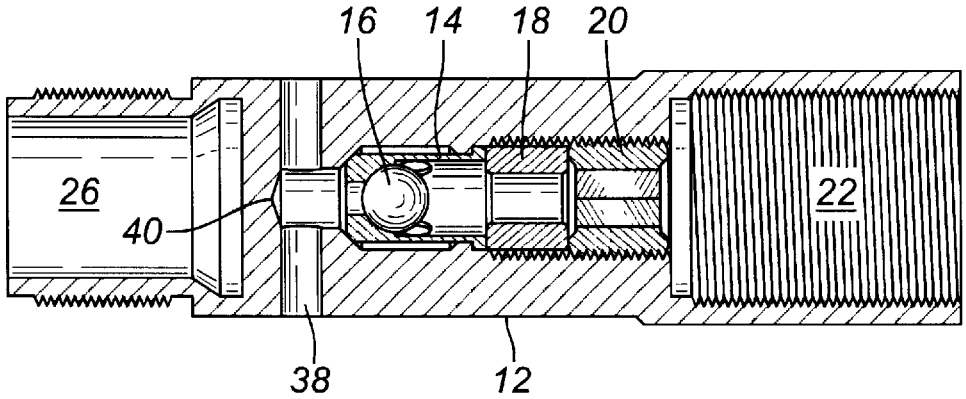
FIG. 1 is a longitudinal section through the present invention taken along line A—A of FIG. 3.
Figure 2:
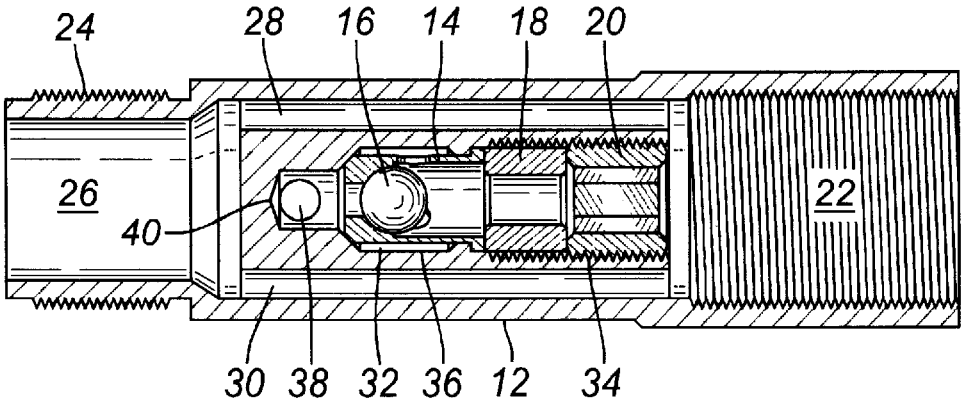
FIG. 2 is another longitudinal section through the present invention, similar to FIG. 1, taken along line B—B of FIG. 3.
Figure 3:
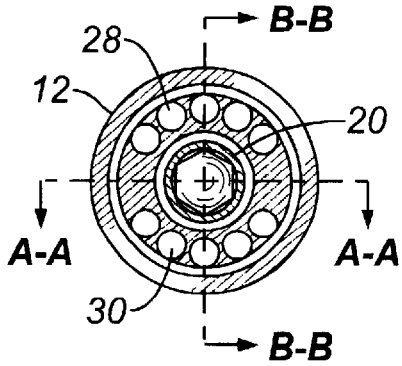
FIG. 3 is an end view of the present invention as viewed from the right of FIG. 2.
Figure 4:
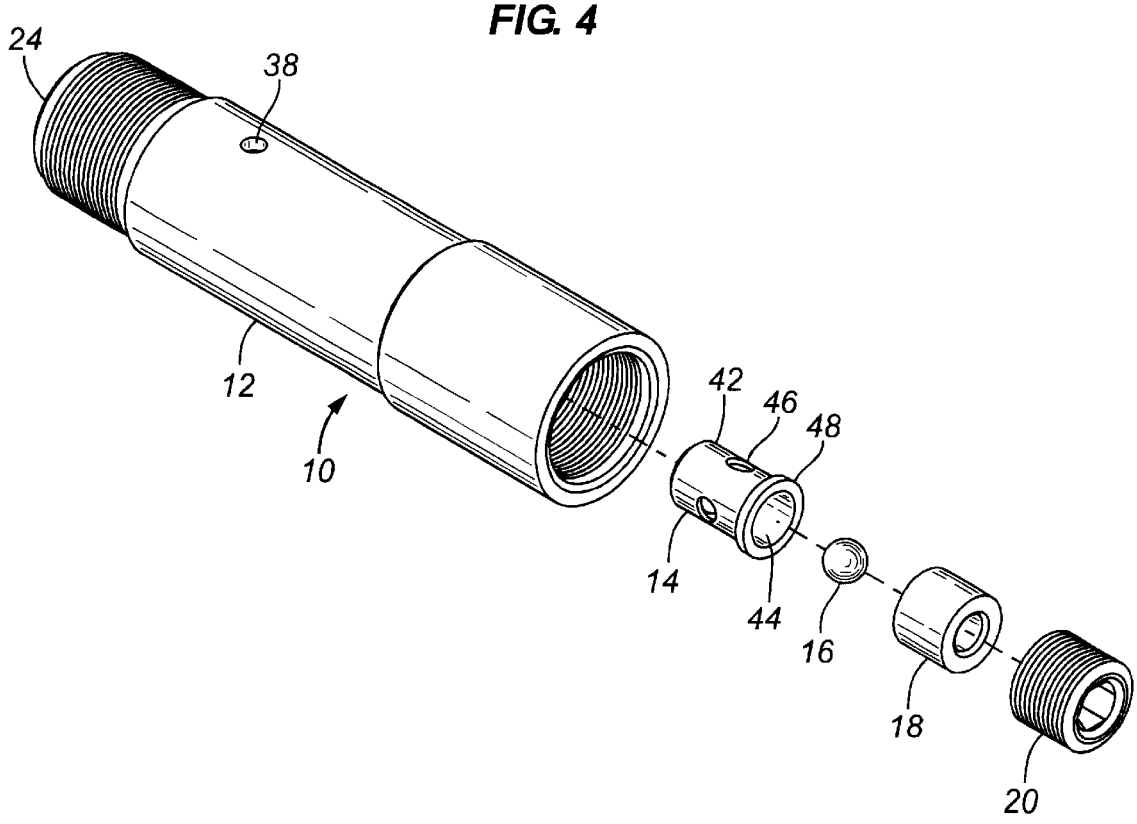
FIG. 4 is an exploded perspective of the subject invention.

Turning to the figures, and FIG. 4 in particular, the subject bottom discharge valve 10 has valve body 12, a cage 14, a ball 16, a valve seat 18 and an externally threaded retainer plug 20. The valve body 12 is a generally elongated cylindrical member with an internally threaded first bore 22 on the first, or lower end. The second, or upper, end of the valve body 12 has external threads 24 and a second bore 26. Intermediate the bores 22 and 26 of the valve body there are first and second pluralities of through ports 28, 30, respectively arranged in circumferential arrays, as best seen in FIG. 3, connect the first and second bores 22, 26, respectively. An axial blind bore 32 extends into the valve body 12 from the first bore 22 and has an internally threaded entrance 34, a profiled chamber 36, and a radial bore 38 adjacent its blind end 40. The arrays of ports 28, 30 surround the axial blind bore 32. The cage 14 is a generally cylindrical member 42 having a blind bore 44 extending inwardly from a first end, at least one radially directed bore 46 adjacent the blind end of the blind bore 44, and an outwardly directed shoulder 48 on the first end thereof The ball 16 is dimensioned to be received in the bore 44, and the cage 14 is dimensioned to be received in the blind bore 32 of the valve body 12. The valve seat 18 is dimensioned to be received in the blind bore 32. The retainer plug 20 is adapted to engage in the threaded entrance of the blind bore 32 to hold the cage 14, ball 16, and valve seat 18 therein.

One of the benefits of the subject bottom discharge valve 10 is in its short length. This short length permits the flushing of sand from even closer to the pump hold-down assembly than has previously been possible. As may be seen in the exploded view of FIG. 4, another important feature of the subject bottom discharge valve 10, when used with a downstroke pump or a pump which pumps fluid only on the downstroke and does not pump fluid on the upstroke (neither type of pump having been shown), is the additional radial bore 38. This additional radial bore 38 allows easier flow of fluid out of the pump barrel (not shown) through the bottom discharge valve 10 and also through the traveling valve (also not shown). Enabling more fluid flow keeps the effective rod weight heavier on the downstroke, making the maximum and minimum loads on the pump drive assembly closer to each other. The closer the maximum and minimum loads are to each other, the smaller the horsepower required to pump fluid from the well.

Additionally, the present disclosed bottom discharge valve incorporates the cage for the valve into the body of the bottom discharge valve, thus eliminating the need for a valve sleeve, thereby reducing the non-compressible free space in the valve by almost 95%. This reduction in free space helps to substantially reduce gas locking of the pump. Additionally, the valve size is smaller than the prior art traveling ball valve and seat. This difference in size reduces the square inches exposed to the hydrostatic load. Specifically, the reduction in square inches exposed to the hydrostatic load results in less pressure needed between the standing valve and the traveling valve for the valve in the bottom discharge to open. This reduction of pressure between the standing valve and the traveling valve enhances the flow of fluid from the pump to the tubing string, particularly when gas is present in the pump.

The bottom discharge valve 10 of the present invention allows the pump to expel fluid together with the traveling valve. It can be used with either a pin or box to connect it to a pump (not shown).

The present invention may be subject to many modifications and changes without departing from the spirit or essential characteristics of the present invention. The present specification should therefor be considered in all respects as illustrative and not restrictive of the scope of the invention as defined by the appended claims.

I claim:

1. A bottom discharge valve comprising:

a valve body formed by a generally elongated cylindrical member with an internally threaded first bore on a first end, external threads and an axially aligned second bore on the opposite second end, a plurality of through ports connecting said first and second bores, an axial blind bore entering said valve body form said first bore and having an internally threaded entrance, a profiled chamber, and at least one radial bore adjacent its blind end;

a generally cylindrical cage member received in said blind bore;

a ball dimensioned to be received in the cage;

a valve seat dimensioned to be received in the blind bore of the valve body; and a retainer plug adapted to engage in the threaded entrance of the blind bore of the valve body to hold the cage, ball, and valve seat therein.

2. A bottom discharge valve according to claim 1 wherein said plurality of through ports are arranged in at least one circumferential array surrounding said axial blind bore.

3. A bottom discharge valve according to claim 1 wherein said cage member has a blind bore extending inwardly from a first end, at least one radially directed bore adjacent the blind end of the blind bore, and an outwardly directed shoulder on the first end thereof.

4. In combination with a downstroke pump, a bottom discharge valve comprising:

a valve body formed by a generally elongated cylindrical member with an internally threaded first bore on a first end, external threads and an axially aligned second bore on the opposite second end, a plurality of through ports connecting said first and second bores, an axial blind bore entering said valve body form said first bore and having an internally threaded entrance, a profiled chamber, and at least one radial bore adjacent its blind end;

a generally cylindrical cage member received in said blind bore;

a ball dimensioned to be received in the cage;

a valve seat dimensioned to be received in the blind bore of the valve body; and a retainer plug adapted to engage in the threaded entrance of the blind bore of the valve body to hold the cage, ball, and valve seat therein wherein said radial bore allows easier flow of fluid out of a pump barrel through the bottom discharge valve and also through a traveling valve whereby the greater fluid flow keeps the effective rod weight heavier on the downstroke, making the maximum and minimum loads on the pump drive assembly closer to each other.

* * * * *